US010890102B2

(12) United States Patent
Hirata et al.

(10) Patent No.: US 10,890,102 B2
(45) Date of Patent: Jan. 12, 2021

(54) COOLING APPARATUS OF INTERNAL COMBUSTION ENGINE

(71) Applicant: TOYOTA JIDOSHA KABUSHIKI KAISHA, Toyota (JP)

(72) Inventors: Yoshiharu Hirata, Sunto-gun (JP); Yuji Miyoshi, Susono (JP); Tomohiro Shinagawa, Sunto-gun (JP); Hiroyuki Sugihara, Sunto-gun (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 172 days.

(21) Appl. No.: 15/965,569

(22) Filed: Apr. 27, 2018

(65) Prior Publication Data

US 2018/0313255 A1 Nov. 1, 2018

(30) Foreign Application Priority Data

May 1, 2017 (JP) ..... 2017-090956

(51) Int. Cl.

| | |
|---|---|
| ***F01P 7/16*** | (2006.01) |
| ***F01P 3/04*** | (2006.01) |
| ***F02F 1/10*** | (2006.01) |
| ***F01P 3/02*** | (2006.01) |
| *F01P 7/14* | (2006.01) |

(52) U.S. Cl.

CPC ..... *F01P 7/167* (2013.01); *F01P 3/04* (2013.01); *F01P 7/164* (2013.01); *F02F 1/10* (2013.01); *F01P 2003/027* (2013.01); *F01P 2007/146* (2013.01)

(58) Field of Classification Search

CPC .... F01P 7/167; F01P 3/04; F01P 7/164; F01P 2003/027; F02F 1/10

See application file for complete search history.

(56) References Cited

U.S. PATENT DOCUMENTS

| | | | | |
|---|---|---|---|---|
| 2005/0028756 | A1* | 2/2005 | Santanam | F01P 7/165 123/41.1 |
| 2006/0213460 | A1* | 9/2006 | Aoki | B60H 1/00885 123/41.05 |
| 2012/0204820 | A1 | 8/2012 | Sasaki et al. | |
| 2015/0176472 | A1* | 6/2015 | Hutchins | F01P 7/16 701/102 |

FOREIGN PATENT DOCUMENTS

| | | |
|---|---|---|
| JP | 2005-036731 A | 2/2005 |
| JP | 2005-315106 | 11/2005 |
| WO | WO 2011/055423 A1 | 5/2011 |

* cited by examiner

*Primary Examiner* — Kevin A Lathers

(74) *Attorney, Agent, or Firm* — Finnegan, Henderson, Farabow, Garrett & Dunner, LLP

(57) ABSTRACT

A cooling apparatus of an internal combustion engine according to the invention controls an activation of a flow rate changing valve such that a block water flow rate proportion when an engine output is relatively large in a range of the engine output equal to or larger than a predetermine engine output, is larger than the block water flow rate proportion when the engine output is relatively small in the range of the engine output equal to or larger than a predetermine engine output.

9 Claims, 8 Drawing Sheets

COOLING APPARATUS OF INTERNAL COMBUSTION ENGINE

BACKGROUND

Field

The invention relates to a cooling apparatus of an internal combustion engine for cooling the internal combustion engine by cooling water.

Description of the Related Art

There is known a cooling apparatus of the internal combustion engine for controlling a flow rate of the cooling water flowing through a water passage formed in a cylinder head of the engine and a flow rate of the cooling water flowing through a water passage formed in a cylinder block of the engine, independently (see JP 2005-315106 A). Hereinafter, the flow rate of the cooling water flowing through the water passage formed in the cylinder head will be referred to as "the head water flow rate", and the flow rate of the cooling water flowing through the water passage formed in the cylinder block will be referred to as "the block water flow rate."

The known cooling apparatus is configured to increase the head water flow rate and decrease the block water flow rate as an engine load corresponding to a load of the engine increases. Further, the known cooling apparatus is configured to increase the head water flow rate and decrease the block water flow rate as an engine speed corresponding to a rotation speed of the engine increases.

Thereby, the cylinder head is prevented from overheat, and the cylinder block is prevented from being cooled excessively.

When the cylinder block is cooled excessively, a viscosity of lubrication oil for lubricating movable parts such as pistons provided in the cylinder block, increases. Thus, friction resistances of the movable parts increases. Accordingly, the block water flow rate should not be large excessively in order to maintain the friction resistances of the movable parts equal to or smaller than a certain value.

The known cooling apparatus decrease the block water flow rate as the engine load increases in order to prevent the cylinder block from being cooled excessively. Further, the known cooling apparatus decrease the block water flow rate as the engine speed increases in order to prevent the cylinder block from being cooled excessively. Thereby, when an operation state of the engine is in the state that the engine load and the engine are large, the block water flow rate is small considerably.

When the operation state of the engine is in the state that the engine load and the engine are large, the amount of the head generated in the combustion chambers of the engine is large considerably. Thus, the block water flow rate should be maintained at a large flow rate in order to prevent the cylinder block from overheating. In this regard, the known cooling apparatus is configured to decrease the block water flow rate as the engine load and the engine speed increase. Thus, the block water flow rate may be smaller than a flow rate capable of preventing the cylinder block from overheating when the engine load and the engine speed increase to certain large values, respectively. Therefore, in the known cooling apparatus, the cylinder block may overheat when the engine load and the engine speed are large.

SUMMARY

The invention has been made for solving above-mentioned problems. An object of the invention is to provide a cooling apparatus of the internal combustion engine capable of preventing the cylinder block from overheating when the engine load and the engine speed are large.

A cooling apparatus of an internal combustion engine (10), comprises a head water passage (51), a block water passage (52), a pump (70), a flow rate changing valve (75), and an electronic control unit (90).

The head water passage (51) is formed in a cylinder head (14) of the internal combustion engine (10). Cooling water for cooling the cylinder head flows through the head water passage. The block water passage (52) is formed in a cylinder block (15) of the internal combustion engine. The cooling water for cooling the cylinder block flows through the block water passage. The pump (70) supplies the cooling water to the head and block water passages. The flow rate changing valve (75) changes a cylinder head water flow rate proportion (Phd) and a cylinder block water flow rate proportion (Pbr). The cylinder head water flow rate proportion is a proportion of a flow rate of the cooling water supplied to the head water passage relative to a total water flow rate which is a sum of the flow rate of the cooling water supplied to the head water passage and the flow rate of the cooling water supplied to the block water passage. The cylinder block water flow rate proportion is a proportion of the flow rate of the cooling water supplied to the block water passage relative to the total water flow rate. The electronic control unit (90) controls an activation of the flow rate changing valve on the basis of an engine output (P) corresponding to an output of the internal combustion engine (10).

The electronic control unit (90) is configured to control the activation of the flow rate changing valve (75) (see a process of a step 790 of FIG. 7) such that the block water flow rate proportion (Pbr) when the engine output (P) is relatively large in a range of the engine output equal to or larger than a predetermine engine output, is larger than the block water flow rate proportion when the engine output is relatively small in the range of the engine output equal to or larger than a predetermine engine output (see a determination "No" at a step 750 and a process of a step 780 of FIG. 7).

When the engine output is equal to or larger than the predetermined engine output, an amount of heat generated in combustion chambers of the internal combustion engine is relatively large. Thus, if the block water flow rate decreases as the engine output increases, the cylinder block may overheat.

According to the invention, the block water flow rate proportion when the engine output is relatively large in the range of the engine output equal to or larger than the predetermined engine output, is larger than the block water flow rate proportion when the engine output is relatively small in the range of the engine output equal to or larger than the predetermined engine output. Thus, the cylinder block may be prevented from overheating.

According to an aspect of the invention, the electronic control unit (90) may be configured to control the activation of the flow rate changing valve (75) (see a process of a step 770 of FIG. 7) such that the block water flow rate proportion (Pbr) when the engine output (P) is relatively large in the range of the engine output smaller than the predetermined engine output, is smaller than the block water flow rate proportion when the engine output is relatively small in the range of the engine output smaller than the predetermined engine output (see a determination "Yes" at the step 750 and a process of a step 760 of FIG. 7).

The amount of the heat generated in the combustion chambers increases as the engine output increases. Thus, a temperature of the cylinder head increases as the engine output increases when a degree of cooling the cylinder head by the cooling water is constant. When the temperature of the cylinder head is high, so-called knocking may be generated in the combustion chambers. Therefore, while the engine output is smaller than a certain value, it is preferred to increase the head water flow rate when the engine output increases in order to prevent the knocking from being generated. On the other hand, the head water flow rate increases as the block water flow rate proportion decreases while a flow rate of the cooling water discharged from the pump is constant.

Therefore, by controlling the activation of the flow rate changing valve such that the block water flow rate proportion when the engine output is relatively large in the range of the engine output smaller than the predetermined engine output, is smaller than the block water flow rate proportion when the engine output is relatively small in the range of the engine output smaller than the predetermined engine output, the head water flow rate when the engine output is relatively large, may be caused to be larger than the head water flow rate when the engine output is relatively small. Thus, the knocking may be prevented from being generated.

Further, according to an aspect of the invention, the electronic control unit (90) may be configured to control the activation of the flow rate changing valve (75) (see the process of the step 770 of FIG. 7) such that the head water flow rate proportion (Phd) is equal to or larger than the block water flow rate proportion (Pbr) when the engine output is smaller than the predetermined engine output (see the determination "Yes" at the step 750 and the process of the step 760 of FIG. 7).

When the engine output is constant, the amount of the heat received by the cylinder head from the combustion chambers is larger than the amount of the heat received by the cylinder block from the combustion chambers. Thus, the temperature of the cylinder head is higher than the temperature of the cylinder block. Therefore, it is preferred to cause the head water flow rate to be larger than the block water flow rate in order to prevent the knocking from being generated.

On the other hand, when the temperature of the cylinder block is low excessively, the viscosity of the lubrication oil for lubricating the movable parts provided in the cylinder block, is large. As a result, the friction resistances of the movable parts are large. Therefore, it is preferred to maintain the temperature of the cylinder block higher than a certain temperature in order to maintain the friction resistances of the movable parts smaller than a certain value. It is effective to maintain the block water flow rate equal to or smaller than a certain flow rate, depending on the engine load in order to maintain the temperature of the cylinder block equal to or higher than a certain temperature.

Therefore, by controlling the activation of the flow rate changing valve such that the head water flow rate proportion is equal to or larger than the block water flow rate proportion when the engine output is smaller than the predetermined engine output, the head water flow rate is caused to be larger than the block water flow rate, and the block water flow rate may be maintained at a value equal to or smaller than a certain flow rate. Thus, the friction resistances of the movable parts may be maintained at a value equal to or smaller than a certain value and the knocking may be prevented from being generated.

According to an aspect of the invention, the electronic control unit (90) may be configured to control an activation of the pump (70) (a process of a step 820 of FIG. 8) such that a flow rate (Vp) of the cooling water discharged from the pump (70) increases as the engine output (P) increases (see a process of a step 810 of FIG. 8).

Thereby, by controlling the activation of the flow rate changing valve such that the block water flow rate proportion when the engine output is relatively large in the range of the engine output smaller than the predetermined engine output, is smaller than the block water flow rate proportion when the engine output is relatively small in the range of the engine output smaller than the predetermined engine output, the head water flow rate when the engine output is relatively large, is larger than the head water flow rate when the engine output is relatively small. Thus, the knocking may be prevented from being generated.

Further, by controlling the activation of the flow rate changing valve such that the head water flow rate proportion is equal to or larger than the block water flow rate proportion when the engine output is smaller than the predetermined engine output, the head water flow rate is caused to be larger than the block water flow rate. Thus, the knocking may be prevented from being generated.

According to an aspect of the invention, the electronic control unit (90) may be configured to control the activation of the flow rate changing valve (75) (the processes of the steps 760 and 770 of FIG. 7) such that an increasing amount of the block water flow rate in response to a predetermined increasing amount of the engine output (P) in a range of the engine output (P) smaller than the predetermined engine output (see the determination "Yes" at the step 750 of FIG. 7), is smaller than the increasing amount of the block water flow rate in response to the predetermined increasing amount of the engine output (P) in a range of the engine output (P) equal to or larger than the predetermined engine output (see the determination "No" at the step 750 of FIG. 7).

It is preferred to cause the head water flow rate when the engine output is relatively large, to be larger than the head water flow rate when the engine output is relatively small in order to prevent the knocking from being generated when the engine output is smaller than a certain value. When the flow rate of the cooling water discharged from the pump increases as the engine output increases, the head water flow rate increases considerably in response to the increase of the engine output by controlling the block water flow rate proportion such that the increasing amount of the block water flow rate in response to the predetermined increasing amount of the engine output in a range of the engine output smaller than a certain value, is smaller than the increasing amount of the block water flow rate in response to the predetermined increasing amount of the engine output in a range of the engine output equal to or larger than the certain value.

Therefore, by controlling the activation of the pump such that the flow rate of the cooling water discharged from the pump increases as the engine output increases, and controlling the activation of the flow rate changing valve such that the increasing amount of the block water flow rate in response to the predetermined increasing amount of the engine output in a range of the engine output smaller than the predetermined engine output, is smaller than the increasing amount of the block water flow rate in response to the predetermined increasing amount of the engine output in a range of the engine output equal to or larger than the predetermined engine output.

According to an aspect of the invention, the electronic control unit (90) may be configured to control the activation of the pump (70) (see the process of the step 820 of FIG. 8) such that the flow rate (Vp) of the cooling water discharged from the pump (70) increases as the engine output (P) increases (see the process of the step 810 of FIG. 8). In this case, the electronic control unit (90) may be configured to control the activation of the flow rate changing valve (75) (see the process of the step 770 of FIG. 7) such that the block water flow rate proportion when the engine output is relatively large in a range of the engine output smaller than the predetermined engine output, is smaller than the block water flow rate proportion when the engine output is relatively small in the range of the engine output smaller than the predetermined engine output (see the determination "Yes" at the step 750 and the process of the step 760 of FIG. 7). In this case, the predetermined engine output may be set to a value of the engine output (P) in which an operation state of the pump (70) corresponds to an operation state in which the cooling water having the flow rate capable of maintaining the temperature of the cylinder block equal to or lower than a predetermined block temperature, cannot be supplied to the block water passage (52).

In this case, the predetermined block temperature may be set to a temperature of the cylinder block (15) at which a friction resistance of a movable part provided in the cylinder block (15) increases as the temperature of the cylinder block (15) and is equal to or smaller than a predetermined friction resistance.

When the friction resistance increases as the temperature of the cylinder block increases, the lubrication oil may lubricate the movable part in the mixed or boundary lubrication. Therefore, by setting the predetermined block temperature to the temperature of the cylinder block at which the friction resistance of a movable part increases as the temperature of the cylinder block and is equal to or smaller than the predetermined friction resistance, shortage of the lubrication oil film is prevented from being generated.

Further, according to an aspect of the invention, the electronic control unit (90) may be configured to control the activation of the pump (70) (see the process of the step 820 of FIG. 8) such that the flow rate (Vp) of the cooling water discharged from the pump increases as the engine output (P) increases (see the process of the step 810 of FIG. 8). In this case, the predetermined engine output (PL) may be set to a value of the engine output at which the flow rate of the cooling water discharged from the pump corresponds to an upper limit of the flow rate of the cooling water discharged from the pump.

When the flow rate of the cooling water discharged from the pump reaches the upper limit of the flow rate of the cooling water discharged from the pump, the block flow rate may not be increased even by increasing the flow rate of the cooling water discharged from the pump. Therefore, in this case, by setting the predetermined engine output to the value of the engine output at which the flow rate of the cooling water discharged from the pump corresponds to an upper limit of the flow rate of the cooling water discharged from the pump, the block water flow rate proportion increases and thus, the block water flow rate increases when the flow rate of the cooling water discharged from the pump reaches the upper limit of the flow rate of the cooling water discharged from the pump. Thus, the cylinder block is prevented from overheating.

According to an aspect of the invention, the pump (70) may be an electric pump driven by electric power. In this case, the predetermined engine output (PL) may be set to a value of the engine output (P) at which the flow rate (Vp) of the cooling water discharged from the pump (70) corresponds to an upper limit of the flow rate (Vp) of the cooling water discharged from the pump (70).

When the flow rate of the cooling water discharged from the pump reaches the upper limit of the flow rate of the cooling water discharged from the pump, the flow rate of the cooling water discharged from the pump may not increase. Thus, when the flow rate of the cooling water discharged from the pump reaches the upper limit of the flow rate of the cooling water discharged from the pump, the block water flow rate may not increase. Therefore, by setting the predetermined engine output to a value of the engine output at which the flow rate of the cooling water discharged from the pump corresponds to the upper limit of the flow rate of the cooling water discharged from the pump, the cylinder block is prevented from overheating even when the flow rate of the cooling water discharged from the pump may not increase.

Further, according to an aspect of the invention, the pump (70) may be driven by rotation of a crank shaft of the internal combustion engine (10). In this case, the predetermined engine output (PL) may be set to a value of the engine output (P) when a speed (NE) of rotation of the internal combustion engine corresponds to a speed at which the flow rate (Vp) of the cooling water discharged from the pump corresponds to an upper limit of the flow rate of the cooling water discharged from the pump.

The speed of the rotation of the internal combustion engine may not exceed a certain speed due to a configuration of the internal combustion engine. Therefore, when the pump is a type of the pump driven by the rotation of the crank shaft, the flow rate of the cooling water discharged from the pump may not increase after the speed of the rotation of the internal combustion engine reaches an upper limit of the speed of the rotation of the internal combustion engine. Thus, the flow rate of the cooling water discharged from the pump may not increase to increase the block water flow rate after the speed of the rotation of the internal combustion engine reaches an upper limit of the speed of the rotation of the internal combustion engine. Therefore, when the speed of the rotation of the internal combustion engine reaches the upper limit of the speed of the rotation of the internal combustion engine, the flow rate of the cooling water discharged from the pump corresponds to the upper limit of the flow rate of the cooling water discharged from the pump. Accordingly, by setting the predetermined engine output to the value of the engine output when the speed of the rotation of the internal combustion engine corresponds to the speed at which the flow rate of the cooling water discharged from the pump corresponds to the upper limit of the flow rate of the cooling water discharged from the pump, the cylinder block is prevented from overheating even when the flow rate of the cooling water discharged from the pump may not increase.

In the above description, for facilitating understanding of the present invention, elements of the present invention corresponding to elements of an embodiment described later are denoted by reference symbols used in the description of the embodiment accompanied with parentheses. However, the elements of the present invention are not limited to the elements of the embodiment defined by the reference symbols. The other objects, features, and accompanied advantages of the present invention can be easily understood from the description of the embodiment of the present invention along with the drawings.

DESCRIPTION OF THE PREFERRED EMBODIMENTS

Below, a cooling apparatus of an internal combustion engine according to an embodiment of the invention will be described with reference to the drawings. The cooling apparatus according to the embodiment is applied to an internal combustion engine 10 shown in FIG. 1 and FIG. 2. Hereinafter, the cooling apparatus according to the embodiment will be referred to as "the embodiment apparatus." The engine 10 is a multi-cylinder (in this embodiment, linear-four-cylinder) four-cycle piston-reciprocation type diesel engine. The engine 10 may be a gasoline engine.

Figure 1:
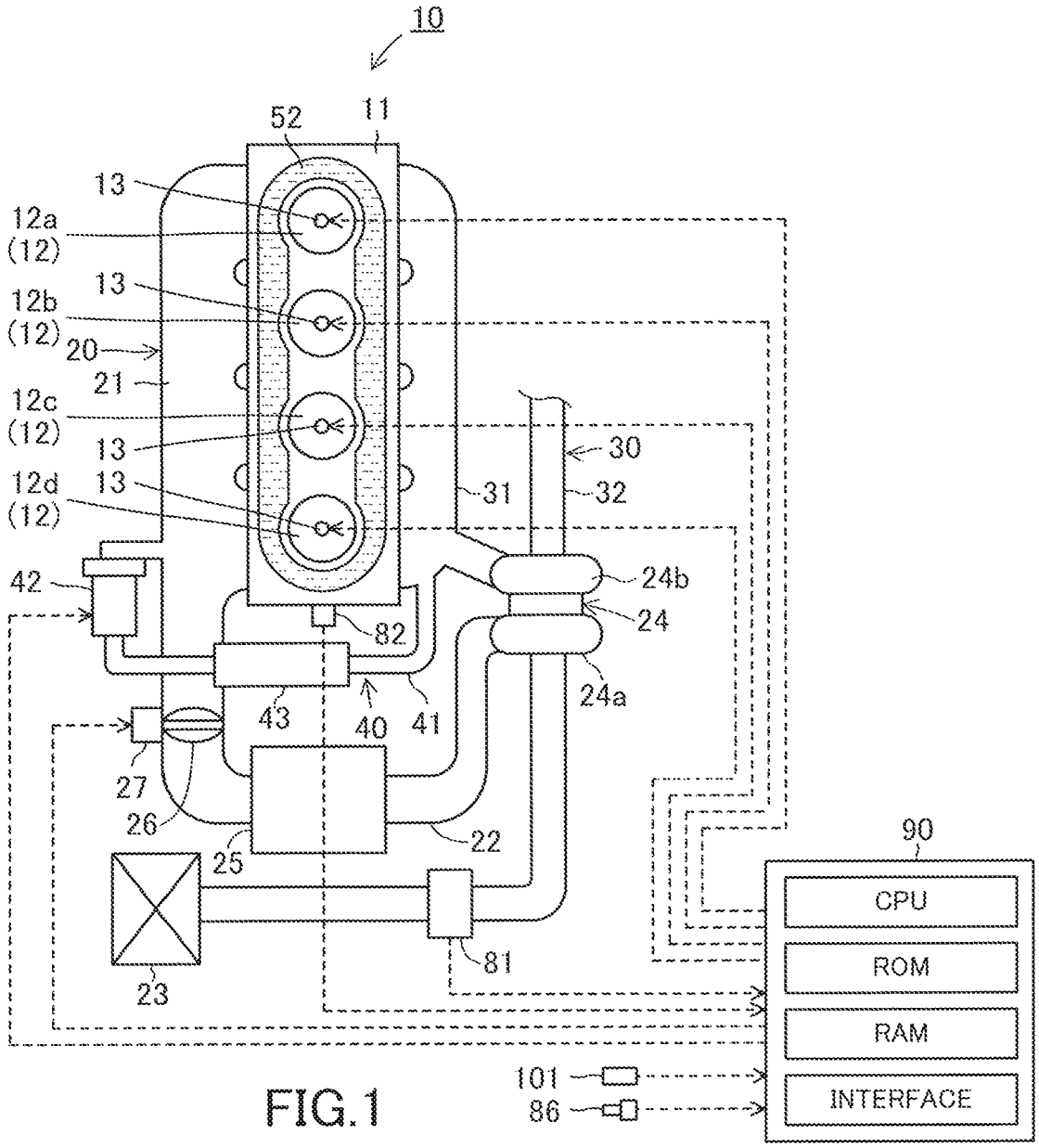
FIG. 1 is a view for showing an internal combustion engine to which a cooling apparatus according to an embodiment of the invention is applied.

As shown in FIG. 1, the engine 10 includes an engine body 11, an intake system 20, an exhaust system 30, and an EGR system 40.

Figure 2:
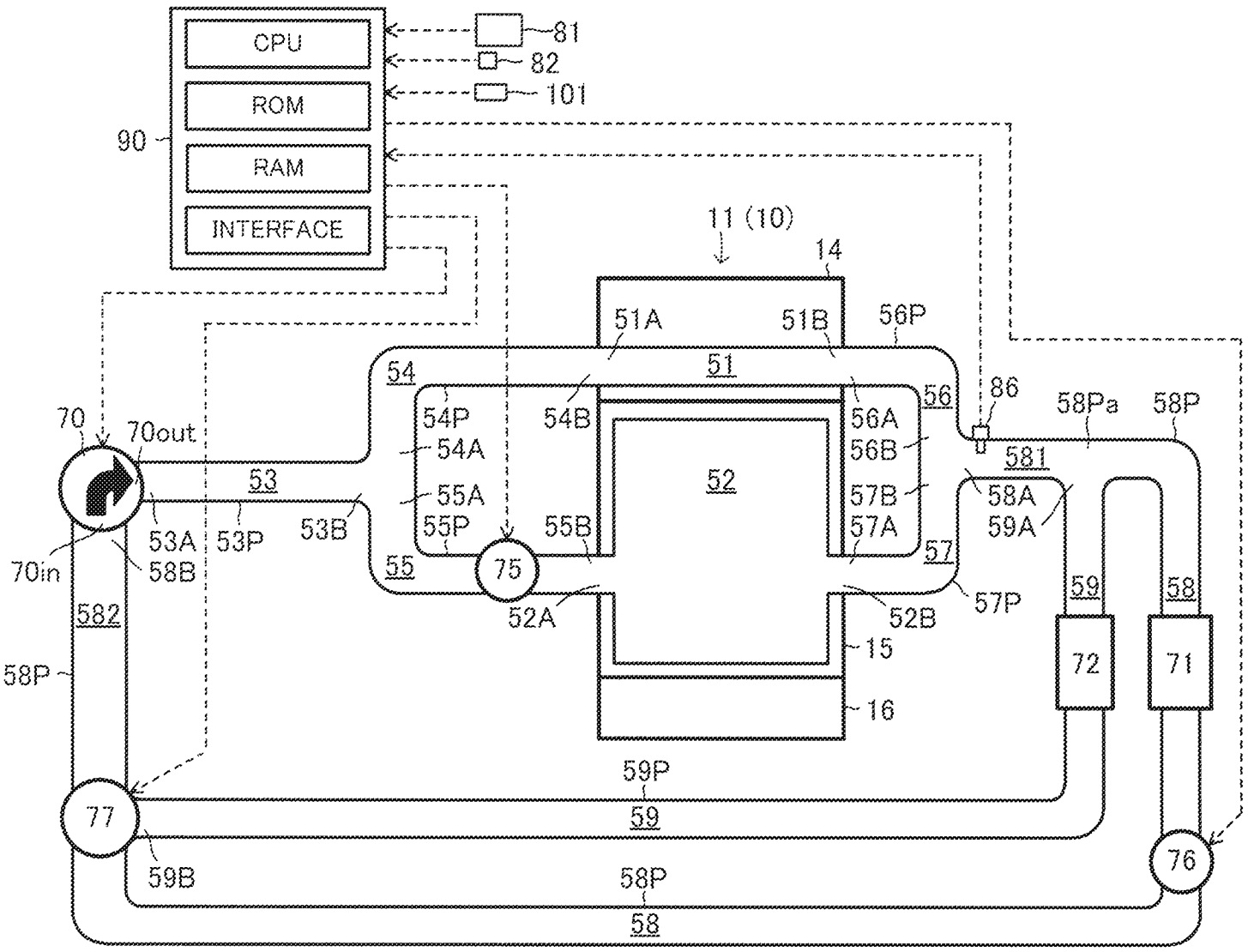
FIG. 2 is a view for showing the cooling apparatus according to the embodiment.

As shown in FIG. 2, the engine body 11 includes a cylinder head 14, a cylinder block 15, a crank case 16 and the like. As shown in FIG. 1, four cylinders or combustion chambers 12*a* to 12*d* are formed in the engine body 11. Fuel injectors 13 are provided such that the fuel injectors 13 expose to upper areas of the cylinders 12*a* to 12*d*, respectively. Hereinafter, the cylinders 12*a* to 12*d* will be collectively referred to as "the cylinders 12."

The intake system 20 includes an intake manifold 21, an intake pipe 22, an air cleaner 23, a compressor 24*a* of a turbocharger 24, an intercooler 25, a throttle valve 26, and a throttle valve actuator 27.

The intake manifold 21 includes branch portions and a collecting portion. The branch portions are connected to the cylinders 12, respectively and to a collecting portion. The intake pipe 22 is connected to the collecting portion of the intake manifold 21. The intake manifold 21 and the intake pipe 22 define an intake passage. The air cleaner 23, the compressor 24*a*, the intercooler 25, and the throttle valve 26 are provided at the intake pipe 22 in order from upstream to downstream in a flow direction of the intake air.

The exhaust system 30 includes an exhaust manifold 31, an exhaust pipe 32, and a turbine 24*b* of the turbocharger 24.

The exhaust manifold 31 includes branch portions and a collecting portion. The branch portions are connected to the cylinders 12, respectively and to a collecting portion. The exhaust pipe 32 is connected to the collecting portion of the exhaust manifold 31. The exhaust manifold 31 and the exhaust pipe 32 define an exhaust passage. The turbine 24*b* is provided in the exhaust pipe 32.

The EGR system 40 includes an exhaust gas recirculation pipe 41, an EGR control valve 42, and an EGR cooler 43.

The exhaust gas recirculation pipe 41 communicates with the exhaust passage upstream of the turbine 24*b*, in particular, the exhaust manifold 31 and the intake passage downstream of the throttle valve 26, in particular, the intake manifold 21. The exhaust gas recirculation pipe 41 defines an EGR gas passage.

The EGR control valve 42 is provided in the exhaust gas recirculation pipe 41. The EGR control valve 42 changes a passage cross-section area of the EGR gas passage in response to the commands output from the electronic control unit 90, thereby, changing an amount of an exhaust gas (i.e., an EGR gas) recirculated from the exhaust passage to the intake passage.

The EGR cooler 43 is provided in the exhaust gas recirculation pipe 41 and lowers a temperature of the EGR gas passing through the exhaust gas recirculation pipe 41 by cooling water as described later. Therefore, the EGR cooler 43 is a heat exchanger for exchanging heat between the cooling water and the EGR gas, in particular, the heat exchanger for applying the heat from the EGR gas to the cooling water.

As shown in FIG. 2, a water passage 51 is formed in the cylinder head 14 in a known matter. Cooling water for cooling the cylinder head 14 flows through the water passage 51. Hereinafter, the water passage 51 will be referred to as "the head water passage 51." The head water passage 51 is one of elements of the embodiment apparatus. Hereinafter, the water passage is a passage through which the cooling water flows.

A water passage 52 is formed in the cylinder block 15 in a known matter. The cooling water for cooling the cylinder block 15 flows through the water passage 52. Hereinafter, the water passage 52 will be referred to as "the block water passage 52." In particular, the block water passage 52 is formed from an area near the cylinder head 14 to an area remote from the cylinder head 14 along cylinder bores defining the cylinders 12, thereby cooling the cylinder bores. The block water passage 52 is one of the elements of the embodiment apparatus.

The embodiment apparatus includes a water pump 70. The water pump 70 is an electric water pump driven by electric power. The water pump 70 may be a pump driven by rotation of a crank shaft (not shown) of the engine 10.

The pump 70 has a suctioning opening 70in and a discharging opening 70out. The cooling water is suctioned into the pump 70 via the suctioning opening 70in. The suctioned cooling water is discharged from the pump 70 via the discharging opening 70out. Hereinafter, the suctioning opening 70in will be referred to as "the pump suctioning opening 70in", and the discharging opening 70out will be referred to as "the pump discharging opening 70out."

A cooling water pipe 53P defines a water passage 53. A first end 53A of the cooling water pipe 53P is connected to the pump discharging opening 70out. Therefore, the cooling water discharged via the pump discharging opening 70out flows into the water passage 53.

A cooling water pipe 54P defines a water passage 54. A cooling water pipe 55P defines a water passage 55. A first end 54A of the cooling water pipe 54P and a first end 55A of the cooling water pipe 55P are connected to a second end 53B of the cooling water pipe 53P.

A second end 54B of the cooling water pipe 54P is connected to the cylinder head 14 such that the water passage 54 communicates with a first end 51A of the head water passage 51. A second end 55B of the cooling water pipe 55P is connected to the cylinder block 15 such that the water passage 55 communicates with a first end 52A of the block water passage 52.

A flow rate changing valve 75 is provided in the cooling water pipe 55P. The flow rate changing valve 75 permits the cooling water to flow through the water passage 55 when the flow rate changing valve 75 is set to an open position. The flow rate changing valve 75 shuts off a flow of the cooling water through the water passage 55 when the flow rate changing valve 75 is set to a closed position. Further, as an opening degree of the flow rate changing valve 75 increases, the flow rate of the cooling water flowing through the flow rate changing valve 75 increases.

A cooling water pipe 56P defines a water passage 56. A first end 56A of the cooling water pipe 56P is connected to the cylinder head 14 such that the water passage 56 communicates with a second end 51B of the head water passage 51. A cooling water pipe 57P defines a water passage 57. A first end 57A of the cooling water pipe 57P is connected to the cylinder block 15 such that the water passage 57 communicates with a second end 52B of the block water passage 52.

A cooling water pipe 58P defines a water passage 58. A first end 58A of the cooling water pipe 58P is connected to a second end 56B of the cooling water pipe 56P and a second end 57B of the cooling water pipe 57P. A second end 58B of the cooling water pipe 58P is connected to the pump suctioning opening 70in. The cooling water pipe 58P is provided such that the cooling water pipe 58P passes through a radiator 71. The radiator 71 exchanges the heat between the cooling water passing through the radiator 71 and an outside air, thereby lowering the temperature of the cooling water. Hereinafter, the water passage 58 will be referred to as "the radiator water passage 58."

A flow rate changing valve 76 is provided in the cooling water pipe 58P between the second end 58B of the cooling water pipe 58P and the radiator 71. When the flow rate changing valve 76 is set to an opening position, the flow rate changing valve 76 permits the cooling water to flow through the radiator water passage 58. On the other hand, when the flow rate changing valve 76 is set to a closed position, the flow rate changing valve 76 shuts off a flow of the cooling water through the radiator water passage 58. Further, as an opening degree of the flow rate changing valve 76 increases, a flow rate of the cooling water passing through the flow rate changing valve 76, increases. Hereinafter, the flow rate changing valve 76 will be referred to as "the radiator flow rate changing valve 76."

A cooling water pipe 59P defines a water passage 59. A first end 59A of the cooling water pipe 59P is connected to a portion 58Pa of the cooling water pipe 58P between the first end 58A of the cooling water pipe 58P and the radiator 71. The cooling water pipe 59P is provided such that the cooling water pipe 59P passes through a thermal device 72. Hereinafter, a portion 581 of the radiator water passage 58 between the first end 58A of the cooling water pipe 58P and the portion 58Pa of the cooling water pipe 60P, will be referred to as "the first portion 581 of the radiator water passage 58."

The thermal device 72 includes the EGR cooler 43 and a heater core (not shown). When the temperature of the cooling water passing through the heater core is higher than a temperature of the heater core, the heater core is warmed by the cooling water, thereby storing heat. Therefore, the heater core is a heat exchanger for exchanging the heat with the cooling water. In particular, the heater core is a heat exchanger for removing the heat from the cooling water. The heat stored in the heater core is used for warming an interior of a vehicle having the engine 10.

A second end 59B of the cooling water pipe 59P is connected to a switching valve 77 provided in the cooling water pipe 58P between the radiator flow rate changing valve 76 and the second end 58B of the cooling water pipe 58P. Hereinafter, a portion 582 of the radiator water passage 58 between the second end 58B of the cooling water pipe 58P and the switching valve 77, will be referred to as "the second portion 582 of the radiator water passage 58."

When the switching valve 77 is set to a first position, the switching valve 77 permits the cooling water to flow from a portion of the radiator water passage 58 upstream of the switching valve 77 to a portion of the radiator water passage 58 downstream of the switching valve 77 and shuts off a flow of the cooling water from the thermal device water passage 59 to the portion of the radiator water passage 58 downstream of the switching valve 77.

On the other hand, when the switching valve 77 is set to a second position, the switching valve 77 permits the cooling water to flow from the portion of the radiator water passage 58 upstream of the switching valve 77 to the portion of the radiator water passage 58 downstream of the switching valve 77 and permits the cooling water to flow from the thermal device water passage 59 to the portion of the radiator water passage 58 downstream of the switching valve 77.

The embodiment apparatus has the electronic control unit 90. The electronic control unit 90 is an electronic control circuit. Hereinafter, the electronic control unit 90 will be referred to as "the ECU 90." The ECU 90 includes a micro-computer as a main component part. The micro-computer includes a CPU, a ROM, a RAM, an interface and the like. The CPU executes instructions or routines stored in a memory such as the ROM, thereby realizing various functions described later.

As shown in FIG. 1 and FIG. 2, the ECU 90 is electrically connected to an air flow meter 81, a crank angle sensor 82, a water temperature sensor 86, and an acceleration pedal operation amount sensor 101.

The air flow meter 81 is provided in the intake pipe 22 upstream of the compressor 24*a*. The air flow meter 81 measures a mass flow rate Ga of an air passing therethrough and sends a signal representing the mass flow rate Ga to the ECU 90. Hereinafter, the mass flow rate Ga will be referred to as "the intake air amount Ga." The ECU 90 acquires the intake air amount Ga on the basis of the signal sent from the air flow meter 81.

The crank angle sensor 82 is provided on the engine body 11 adjacent to a crank shaft (not shown) of the engine 10. The crank angle sensor 82 outputs a pulse signal each time the crank shaft rotates by a constant angle (in this embodiment, 10°). The ECU 90 acquires a crank angle (i.e., an absolute crank angle) of the engine 10 on the basis of the pulse signals and signals sent from a cam position sensor (not shown). The absolute crank angle at a compression top dead center of predetermined one of the cylinders 12, is set to zero. In addition, the ECU 90 acquires an engine speed NE on the basis of the pulse signals sent from the crank angle sensor 82.

The water temperature sensor 86 is provided in a portion of the cooling water pipe 58P defining the first portion 581 of the radiator water passage 58. The water temperature sensor 86 detects a temperature TWeng of the cooling water in the first portion 581 of the radiator water passage 58 and sends a signal representing the temperature TWeng to the ECU 90. Hereinafter, the temperature TWeng will be referred to as "the engine water temperature TWeng." The ECU 90 acquires the engine water temperature TWeng on the basis of the signal sent from the water temperature sensor 86.

The acceleration pedal operation amount sensor 101 detects an operation amount AP of an acceleration pedal (not shown) and sends a signal representing the operation amount AP to the ECU 90. Hereinafter, the operation amount AP will be referred to as "the acceleration pedal operation amount AP." The ECU 90 acquires the acceleration pedal operation amount AP and a load KL of the engine 10 on the basis of the signal sent from the acceleration pedal operation amount sensor 101. Hereinafter the load KL of the engine 10 will be referred to as "the engine load KL."

Further, the ECU 90 is connected to the fuel injectors 13, the throttle valve actuator 27, the EGR control valve 42, the pump 70, the block flow rate changing valve 75, the radiator flow rate changing valve 76, and the switching valve 77.

The throttle valve actuator 27 changes an opening degree of the throttle valve 26 in response to a command sent from the ECU 90.

The fuel injectors 13 open in response to a command sent from the ECU 90 to inject fuel directly into the cylinders 12, respectively.

The ECU 90 sets a target value of the opening degree of the throttle valve 26, depending on an engine operation state and controls the activation of the throttle valve actuator 27 such that the opening degree of the throttle valve 26 corresponds to the target value. The engine operation state is an operation stated of the engine 10 and is defined by the engine load KL and the engine speed NE.

Further, the ECU 90 controls activations of the pump 70, the block flow rate changing valve 75, the radiator flow rate changing valve 76, and the switching valve 77, depending on the engine operation state and presence or absence of a request of supplying the cooling water to the thermal device water passage 59 as described below.

<Summary of Activation of Embodiment Apparatus>

Figure 3:
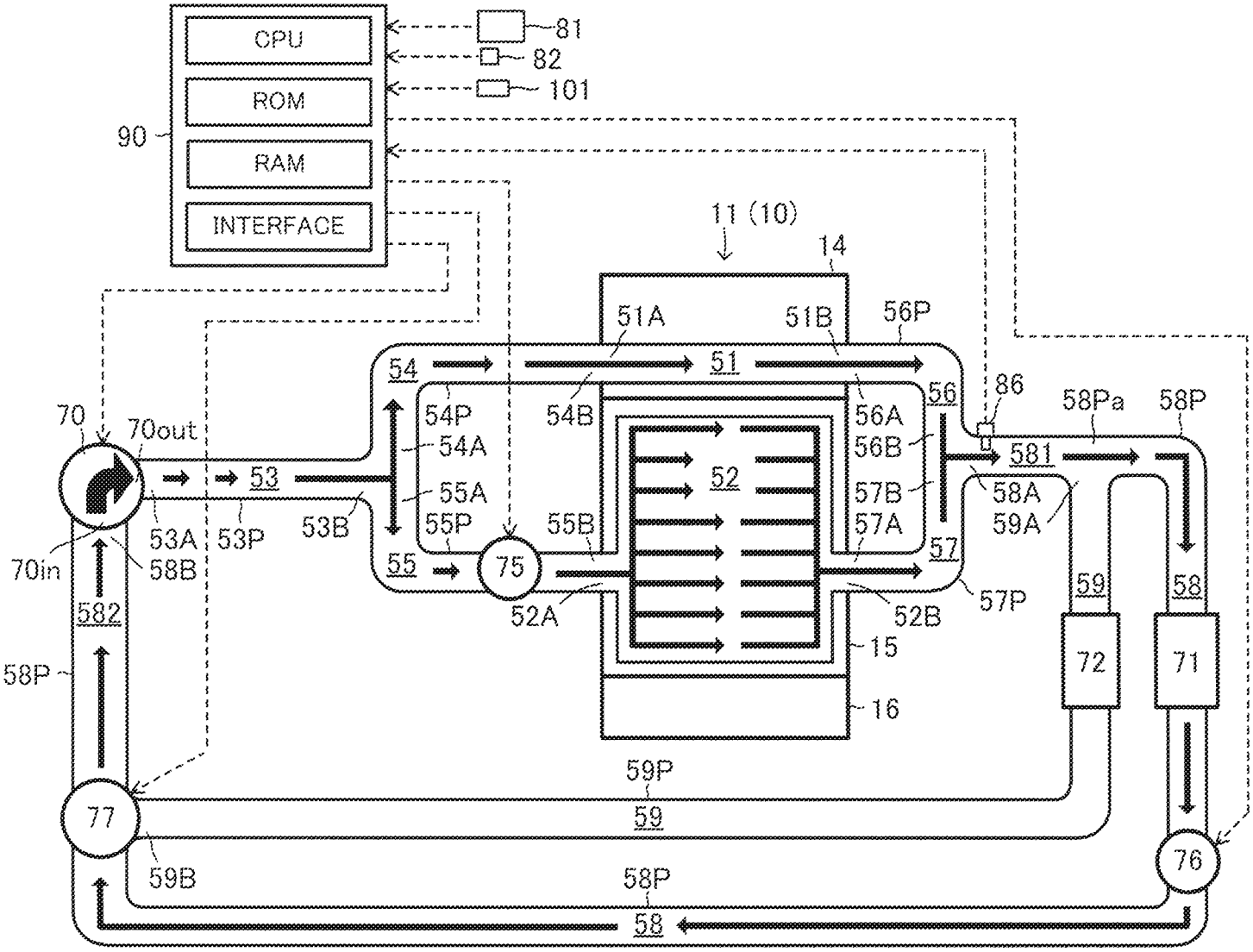
FIG. 3 is a view similar to FIG. 2 and which shows flow of cooling water when the cooling apparatus according to the embodiment executes a cooling water circulation control.

Next, a summary of an activation of the embodiment apparatus will be described. When the cooling water is not requested to be supplied to the thermal device water passage 59 while the engine 10 operates, the embodiment apparatus executes a cooling water circulation control E. According to the cooling water circulation control A, the embodiment apparatus activates the pump 70, sets the flow rate changing valve 75 and 76 to the open positions, respectively, and sets the switching valve 77 to the first position. When the embodiment apparatus executes the cooling water circulation control A, the cooling water circulates as shown by arrows in FIG. 3.

According to the cooling water circulation control A, a part of the cooling water discharged to the water passage 53 via the pump discharging opening 70out, flows into the head water passage 51 through the water passage 54. The remaining of the cooling water discharged to the water passage 53 via the pump discharging opening 70out, flows into the block water passage 52 through the water passage 55.

The cooling water flowing into the head water passage 51, flows through the head water passage 51 and then, flows into the radiator water passage 58 through the water passage 56. The cooling water flowing into the block water passage 52, flows through the block water passage 52 and then, flows into the radiator water passage 58 through the water passage 57. The cooling water flowing into the radiator water passage 58, flows through the radiator 71 and then, is suctioned into the pump 70 via the pump suctioning opening 70in.

Figure 4:
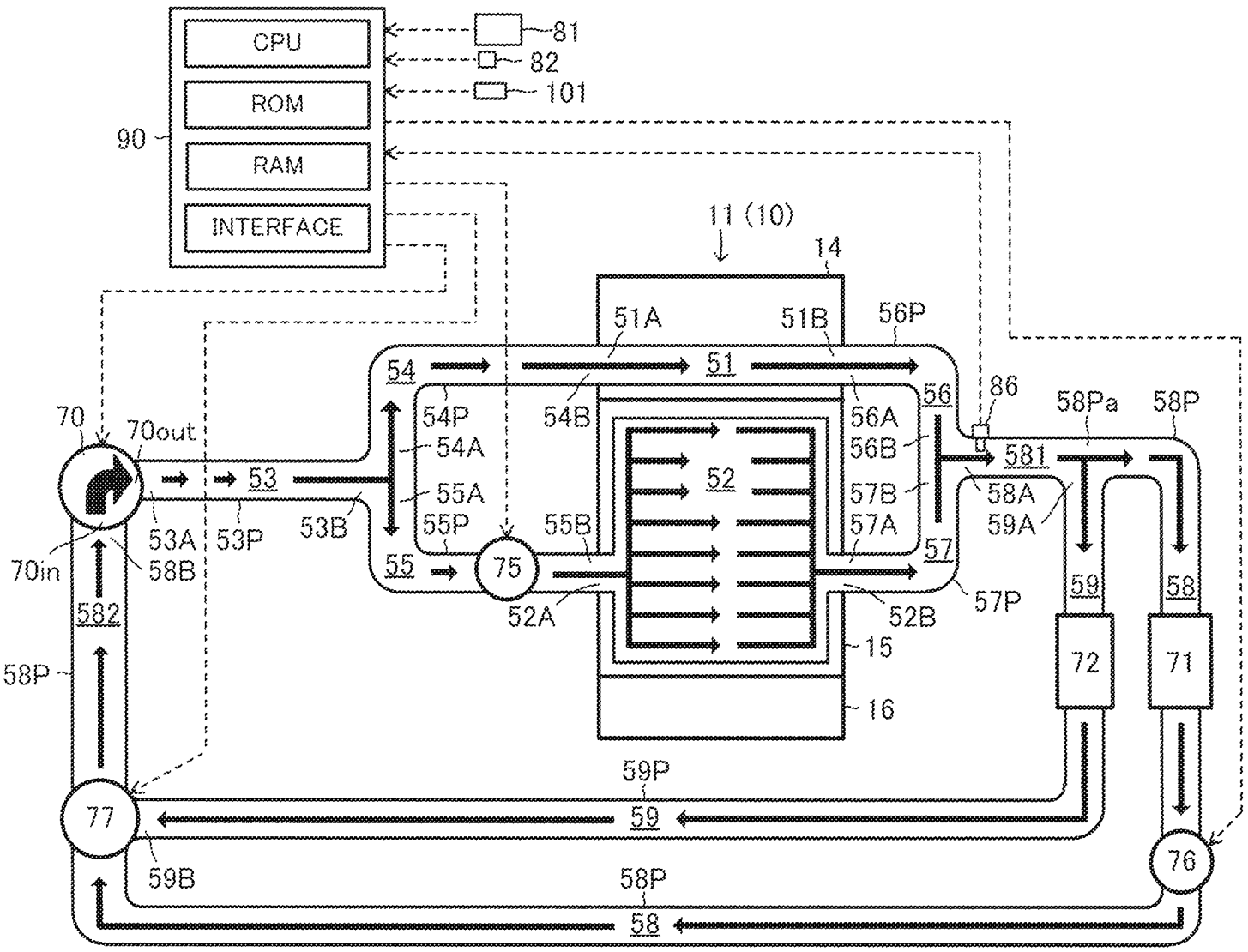
FIG. 4 is a view similar to FIG. 2 and which shows flow of cooling water when the cooling apparatus according to the embodiment executes another cooling water circulation control.

On the other hand, when the cooling water is requested to be supplied to the thermal device water passage 59 while the engine 10 operates, the embodiment apparatus executes a cooling water circulation control B. According to the cooling water circulation control B, the embodiment apparatus activates the pump 70, sets the flow rate changing valve 75 and 76 to the open positions, respectively, and sets the switching valve 77 to the second position. When the embodiment apparatus executes the cooling water circulation control B, the cooling water circulates as shown by arrows in FIG. 4.

According to the cooling water circulation control B, a part of the cooling water discharged to the water passage 53 via the pump discharging opening 70out, flows into the head water passage 51 through the water passage 54. The remaining of the cooling water discharged to the water passage 53 via the pump discharging opening 70out, flows into the block water passage 52 through the water passage 55.

The cooling water flowing into the head water passage 51, flows through the head water passage 51 and then, flows into the radiator water passage 58 through the water passage 56. The cooling water flowing into the block water passage 52, flows through the block water passage 52 and then, flows into the radiator water passage 58 through the water passage 57.

A part of the cooling water flowing into the radiator water passage 58, flows through the radiator 71 and then, is suctioned into the pump 70 via the pump suctioning opening 70in.

The remaining of the cooling water flowing into the radiator water passage 58, flows into the thermal device water passage 59 through the first portion 581 of the radiator water passage 58. The cooling water flowing into the thermal device water passage 59, flows through the thermal device 72 and then, flows through the thermal device water passage 59 and the second portion 582 of the radiator water passage 58. Then, the cooling water is suctioned into the pump 70 via the pump suctioning opening 70in.

As an engine output P (i.e., an output P of the engine 10) increases, an amount of heat generated in the combustion chambers 12 increases. When the engine output P increases while a flow rate Vp of the cooling water discharged from the pump 70 is constant, the engine 10 may overheat. When the engine 10 overheats, the cylinder head 14 and the cylinder block 15 may be deformed, the lubrication oil for lubricating pistons, cam shafts and the like of the engine 10 may be in the boundary lubrication and thus, shortage of the lubrication oil film may be generated, and so-called knocking may be generated in the combustion chambers 12. Therefore, the flow rate Vp of the cooling water discharged from the pump 70 should be increased when the engine output P increases in order to preventing the cylinder head 14 and the cylinder block 15 from being deformed, the shortage of the lubrication oil film from being generated, and the knocking from being generated. Hereinafter, the flow rate Vp of the cooling water discharged from the pump 70 will be referred to as "the pump discharging flow rate Vp."

Further, an amount of the heat received by the cylinder head 14 from the combustion chambers 12 is larger than the amount of the heat received by the cylinder block 15 from the combustion chambers 12. Thus, a cylinder head temperature (i.e., a temperature of the cylinder head 14) may be higher than a cylinder block temperature (i.e., a temperature of the cylinder block 15). When the cylinder head temperature is high excessively, the knocking may be generated in the combustion chambers 12. On the other hand, when the cylinder block temperature is low excessively, a viscosity of lubrication oil for lubricating movable parts such as pistons provided in the cylinder block 15, increases. As a result, friction resistances of the movable parts may increase excessively.

Therefore, the flow rate of the cooling water supplied to the head water passage 51 should be larger than the flow rate of the cooling water supplied to the block water passage 52 in order to prevent the knocking from being generated and the friction resistances of the movable parts from increasing excessively. Hereinafter, the flow rate of the cooling water supplied to the head water passage 51 will be referred to as "the head water flow rate", and the flow rate of the cooling water supplied to the block water passage 52 will be referred to as "the block water flow rate."

Figure 5:
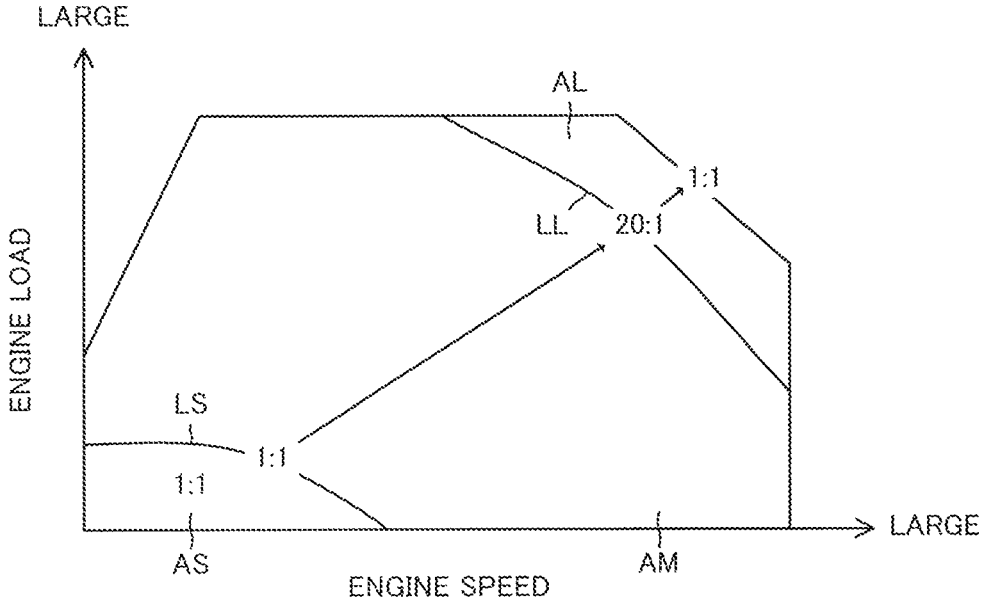
FIG. 5 is a view for showing a relationship of a head flow rate proportion and a block flow rate proportion to an engine speed and an engine load.

The cylinder head temperature when the engine operation state is in an area AM shown in FIG. 5, is higher than the cylinder head temperature when the engine operation state is in an area AS shown in FIG. 5. When the engine operation state is in the area AM, the engine output P is moderate, and hereinafter, the area AM will be referred to as "the middle output area AM." When the engine operation state is in the area AS, the engine output P is relatively small, and hereinafter, the area AS will be referred to as "the small engine output area AS."

Therefore, when the engine operation state is in the small engine output area AS, an amount of the head water flow rate to be increased in response to increasing of the engine output P for preventing the knocking from being generated, is relatively small. On the other hand, when the engine operation state is in the moderate engine output area AM, the amount of the head water flow rate to be increased in response to the increasing of the engine output P for preventing the knocking from being generated, is relatively large.

For the reasons described above, the embodiment apparatus controls the activation of the pump 70 such that the pump discharging flow rate Vp increases as the engine output P increases when the engine operation state is in the small engine output area AS or the moderate engine output area AM.

When the engine operation state is in the moderate engine output area AM, the engine output P is smaller than a threshold engine output PL shown in FIG. 5 corresponding to the engine speed NE and larger than a threshold engine output PS shown in FIG. 5. The threshold engine output PL is the engine output P on a boundary line LL between the moderate engine output area AM and an area AL shown in FIG. 5. The threshold engine output PS is the engine output P on a boundary line LS between the moderate engine output area AM and the small engine output area AS. Hereinafter, the area AL will be referred to as "the large output area AL." On the other hand, when the engine operation state is in the small engine output area AS, the engine output P is equal to or larger than the threshold engine output PS corresponding to the engine speed NE. Further, when the engine operation state is in the large engine output area AL, the engine output P is equal to or larger than the threshold engine output PL corresponding to the engine speed NE.

As shown in FIG. 5, when the engine operation state is in the small engine output area AS, the embodiment apparatus controls the opening degree of the flow rate changing valve 75 such that a head water flow rate proportion Phd and a block water flow rate proportion Pbr are equal to each other (Phd:Pbr=1:1). In this regard, the head water flow rate proportion Phd is a proportion Phd of the head water flow rate relative to a total flow rate. The block water flow rate proportion Pbr is a proportion Pbr of the block water flow rate relative to the total flow rate. The total flow rate is a sum of the head water flow rate and the block water flow rate.

Figure 6:
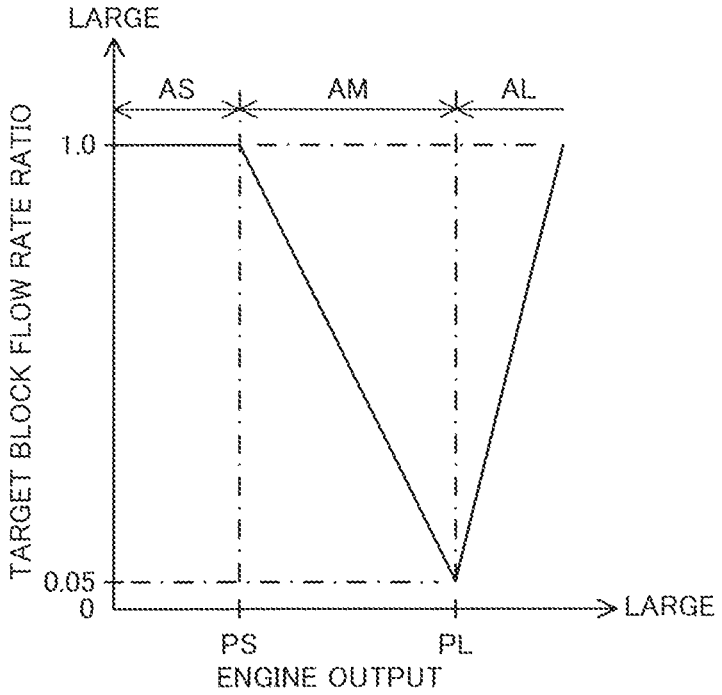
FIG. 6 is a view for showing a relationship of a target block flow rate proportion to an engine output.

In other words, as shown in FIG. 6, when the engine operation state is in the small engine output area AS, the embodiment apparatus controls the opening degree of the flow rate changing valve 75 such that the ratio of the block water flow rate proportion Pbr relative to the head water flow rate proportion Phd is controlled to a constant value, in this embodiment, "1."

Hereinafter, the ratio of the block water flow rate proportion Pbr relative to the head water flow rate proportion Phd will be referred to as "the block water flow rate ratio Rbr."

When the engine operation state is in the small engine output area AS, the embodiment apparatus may control the opening degree of the flow rate changing valve 75 such that the block water flow rate proportion Pbr when the engine output P is relatively large, is smaller than the block water flow rate proportion Pbr when the engine output P is relatively small and as a result, the head water flow rate proportion Phd increases.

In particular, when the engine operation state is in the small engine output area AS, the embodiment apparatus may control the opening degree of the flow rate changing valve 75 such that the block water flow rate proportion Pbr decreases as the engine output P increases, and as a result, the head water flow rate proportion Phd increases as the engine output P increases.

In this case, the embodiment apparatus may be configured to control the opening degree of the flow rate changing valve 75 such that the increasing amount of the block water flow rate in response to the predetermined increasing amount of the engine output P when the engine operation state is in the small engine output area AS, is smaller than the increasing amount of the block water flow rate in response to the predetermined increasing amount of the engine output P when the engine operation state is in the moderate engine output area AM.

On the other hand, when the engine operation state is in the moderate engine output area AM, the embodiment apparatus controls the opening degree of the flow rate changing valve 75 such that the block water flow rate proportion Pbr decreases as the engine output P increases, and as a result, the head water flow rate proportion Phd increases as the engine output P increases.

In particular, as shown in FIG. 5, in this embodiment, the embodiment apparatus controls the opening degree of the flow rate changing valve 75 such that the head water flow rate proportion Phd and the block water flow rate proportion Pbr are controlled as Phd:Pbr=1:1 when the engine output P is on the boundary line LS. On the other hand, the embodiment apparatus controls the opening degree of the flow rate changing valve 75 such that the head water flow rate proportion Phd and the block water flow rate proportion Pbr are controlled as Phd:Pbr=20:1 when the engine output P is on the boundary line LL.

In other words, as shown in FIG. 6, the embodiment apparatus controls the opening degree of the flow rate changing valve 75 such that the block water flow rate ratio Rbr is controlled to "1" when the engine output P is on the boundary line LS. Further, when the engine output P is on the boundary line LL, the embodiment apparatus controls the opening degree of the flow rate changing valve 75 such that the block water flow rate ratio Rbr is controlled to "0.05."

In this embodiment, when the engine operation state is in the moderate engine output area AM, the head water flow rate proportion Phd and the block water flow rate proportion Pbr, and the pump discharging flow rate Vp are set to proportions and a flow rate, respectively capable of maintaining the cylinder head temperature and the cylinder block temperature at temperatures capable of preventing the cylinder head 14 and the cylinder block 15 from being deformed, the shortage of the lubrication oil film from being generated, and the knocking from being generated. Therefore, when the engine operation is in the moderate engine output area AM, the cylinder head 14 and the cylinder block 15 are prevented from being deformed, the shortage of the lubrication oil film from being generated, and the knocking from being generated.

According to the embodiment apparatus, the head water flow rate is larger than the block water flow rate when the engine operation state is in the moderate engine output area AM and as a result, the cylinder head temperature is likely to increase excessively, and the cylinder block temperature is likely to decrease excessively. Thus, the knocking is prevented from being generated, and the friction resistance of the cylinder block movable parts are prevented from increasing excessively when the engine operation state is in the moderate engine output area AM.

In addition, the increasing amount of the head water flow rate in response to the predetermined increasing amount of the engine output P when the engine operation state is in the moderate engine output area AM, is larger than the increasing amount of the head water flow rate in response to the predetermined increasing amount of the engine output P when the engine operation state is in the small engine output area AS. Thus, the knocking is prevented from being generated when the engine operation state is in the moderate engine output area AM.

The embodiment apparatus may be configured to control the opening degree of the flow rate changing valve 75 such that the block water flow rate proportion Pbr in response to the relatively large engine output P, is smaller than the block water flow rate proportion Pbr in response to the relatively small engine output P when the engine operation state is in the moderate engine output area AM.

When the block water flow rate proportion Pbr decreases as the engine output P increases while the engine output P exceeds a certain value and thus, the amount of the heat generated in the combustion chambers 12, is large considerably, the block water flow rate is smaller than a flow rate necessary to prevent the cylinder block 15 from overheating and thus, the cylinder block 15 may overheat.

In particular, when the block water flow rate proportion Pbr decreases as the engine output P increases while the engine output P increases and thus, the pump discharging flow rate Vp reaches an upper limit of the flow rate of the cooling water which the pump 70 can discharge, the block water flow rate decreases as the engine output P increases. Thus, the block water flow rate is smaller than the flow rate of the cooling water necessary to prevent the cylinder block 15 from overheating and thus, the cylinder block 15 is likely to overheat.

For the reasons described above, as shown in FIG. 5, when the engine operation state is in the large engine output area AL, the embodiment apparatus controls the opening degree of the flow rate changing valve 75 such that the block water flow rate proportion Pbr increases as the engine output P increases.

In this embodiment, the embodiment apparatus controls the opening degree of the flow rate changing valve 75 such that the head water flow rate proportion Phd and the block water flow rate proportion Pbr are controlled as Phd:Pbr=20:1 when the engine operation state is in the large engine output area AL and the engine output P is on the boundary line LL. On the other hand, the embodiment apparatus controls the opening degree of the flow rate changing valve 75 such that the head water flow rate proportion Phd and the block water flow rate proportion Pbr are controlled as Phd:Pbr=1:1 when the engine operation state is in the large engine output area AL and the engine output P corresponds to an upper limit of the engine output P.

In other words, as shown in FIG. 6, the embodiment apparatus controls the opening degree of the flow rate changing valve 75 such that the block water flow rate ratio Rbr is controlled to "0.05" when the engine operation state is in the large engine output area AL and the engine output P is on the boundary line LL. Further, the embodiment apparatus controls the opening degree of the flow rate changing valve 75 such that the block water flow rate ratio Rbr is controlled to "1" when the engine operation state is in the large engine output area AL and the engine output P is an upper limit thereof.

According to the embodiment apparatus, the block water flow rate increases as the engine output P increases when the engine operation state is in the large engine output area AL and thus, the cylinder block 15 is likely to overheat. Therefore, the cylinder block 15 is prevented from overheating when the engine operation state is in the large engine output area AL.

The embodiment apparatus may be configured to control the opening degree of the flow rate changing valve 75 such that the block water flow rate proportion Pbr in response to the relatively large engine output P, is larger than the block water flow rate proportion Pbr in response to the relatively small engine output P when the engine operation state is in the large engine output area AL.

In this embodiment, the threshold engine output PL is set to a value of the engine output P corresponding to an upper limit of the pump discharging flow rate Vp. That is, the threshold engine output PL is set to the engine output P in which the operation state of the pump 70 corresponds to an operation state in which the cooling water having the flow rate capable of maintaining the cylinder block temperature equal to or lower than a predetermined cylinder block temperature, cannot be supplied to the block water passage 52.

In particular, the threshold engine output PL is set to the smallest engine output in which the operation state of the pump 70 corresponds to an operation state in which the cooling water having the flow rate capable of maintaining the cylinder block temperature equal to or lower than the predetermined cylinder block temperature, cannot be supplied to the block water passage 52. In this case, the predetermined cylinder block temperature is set to a temperature in a temperature range in which the friction resistances increase as the cylinder block temperature increases and are smaller than predetermined friction resistances. In particular, the predetermined cylinder block temperature is set to a lowest temperature in the temperature range in which the friction resistances increase as the cylinder block temperature increases and are smaller than predetermined friction resistances.

When the pump 70 is a type of a pump driven by the rotation of the crank shaft of the engine 10, the threshold engine output PL is set to the engine output P in which the engine speed NE corresponds to the engine speed NE in which the flow rate of the cooling water discharged from the pump corresponds to an upper limit of the flow rate of the cooling water discharged from the pump. In particular, the threshold engine output PL is set to the engine output P in which the engine speed NE corresponds to the smallest engine speed NE in which the flow rate of the cooling water discharged from the pump corresponds to an upper limit of the flow rate of the cooling water discharged from the pump.

<Concrete Operation of Embodiment Apparatus>

Figure 7:
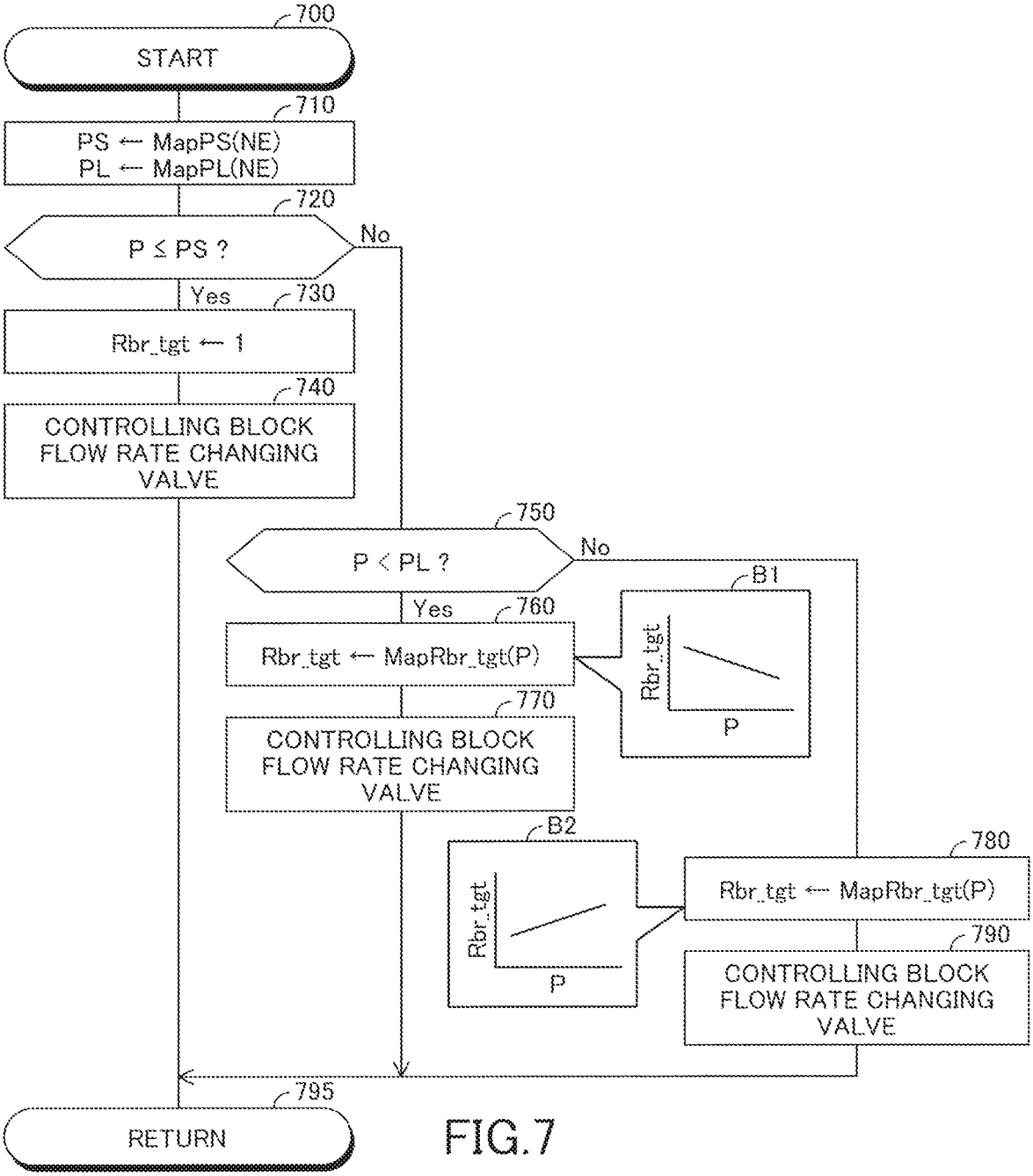
FIG. 7 is a flowchart for showing a routine executed by a CPU of an ECU shown in FIG. 1 and FIG. 2.

Below, a concrete operation of the embodiment apparatus will be described. The CPU of the ECU 90 of the embodiment apparatus is configured or programmed to execute a routine shown by a flowchart in FIG. 7 each time a predetermined time elapses. Therefore, at a predetermined timing, the CPU starts a process from a step 700 of FIG. 7 and then, executes a process of a step 710 described below. Then, the CPU proceeds with the process to a step 720.

Step 710: The CPU applies the engine speed NE to a look-up table Map PS(NE) to acquire the threshold engine output PS and applies the engine speed NE to a look-up table Map PL(NE) to acquire the threshold engine output PL. According to the look-up table Map PS(NE), the acquired threshold engine output PS decreases as the engine speed NE increases. According to the look-up table Map PL(NE), the acquired threshold engine output PL decreases as the engine speed NE increases.

When the CPU proceeds with the process to the step 720, the CPU determines whether the engine output P is equal to or smaller than the threshold engine output PS. When the engine output P is equal to or smaller than the threshold engine output PS, that is, when the engine operation state is in the small engine output area AS shown in FIG. 5, the CPU determines "Yes" at the step 720 and then, sequentially executes processes of steps 730 and 740 described below. Then, the CPU proceeds with the process to a step 795 to terminate this routine once.

Step 730: The CPU sets a target value Rbr_tgt of the block water flow rate ratio Rbr to "1." Hereinafter, the target value Rbr_tgt will be referred to as "the target block water flow rate ratio Rbr_tgt."

Step 740: The CPU controls the opening degree of the flow rate changing valve 75 to accomplish the target block water flow rate ratio Rbr_tgt set at the step 730.

On the other hand, when the engine output P is larger than the threshold engine output PS at a time of the CPU executing the process of the step 720, the CPU determines "No" at the step 720 and then, proceeds with the process to a step 750 to determine whether the engine output P is smaller than the threshold engine output PL.

When the engine output P is smaller than the threshold engine output PL, that is, when the engine operation state is in the moderate engine output area AM shown in FIG. 5, the CPU determines "Yes" at the step 750 and then, sequentially executes processes of steps 760 and 770 described below. Then, the CPU proceeds with the process to the step 795 to terminate this routine once.

Step 760: The CPU applies the engine output P to a look-up table MapRbr_tgt(P) for the moderate engine output area AM to acquire the target block water flow rate ratio Rbr_tgt. According to the look-up table MapRbr_tgt(P) for the moderate engine output area AM, the acquired target block water flow rate ratio Rbr_tgt decreases as the engine output P increases as shown in a block B1 of FIG. 7.

Step 770: The CPU controls the opening degree of the flow rate changing valve 75 to accomplish the target block water flow rate ratio Rbr_tgt acquired at the step 760.

On the other hand, when the engine output P is equal to or larger than the threshold engine output PL, that is, when the engine operation state is in the large engine output area AL shown in FIG. 5 at a time of the CPU executing the process of the step 750, the CPU determines "No" at the step 750 and then, sequentially executes processes of steps 780 and 790 described below. Then, the CPU proceeds with the process to the step 795 to terminate this routine once.

Step 780: The CPU applies the engine output P to a look-up table MapRbr_tgt(P) for the large engine output area AL to acquire the target block water flow rate ratio Rbr_tgt. According to the look-up table MapRbr_tgt(P) for the large engine output area AL, the acquired target block water flow rate ratio Rbr_tgt increases as the engine output P increases.

Step 790: The CPU controls the opening degree of the flow rate changing valve 75 to accomplish the target block water flow rate ratio Rbr_tgt acquired at the step 780.

Figure 8:
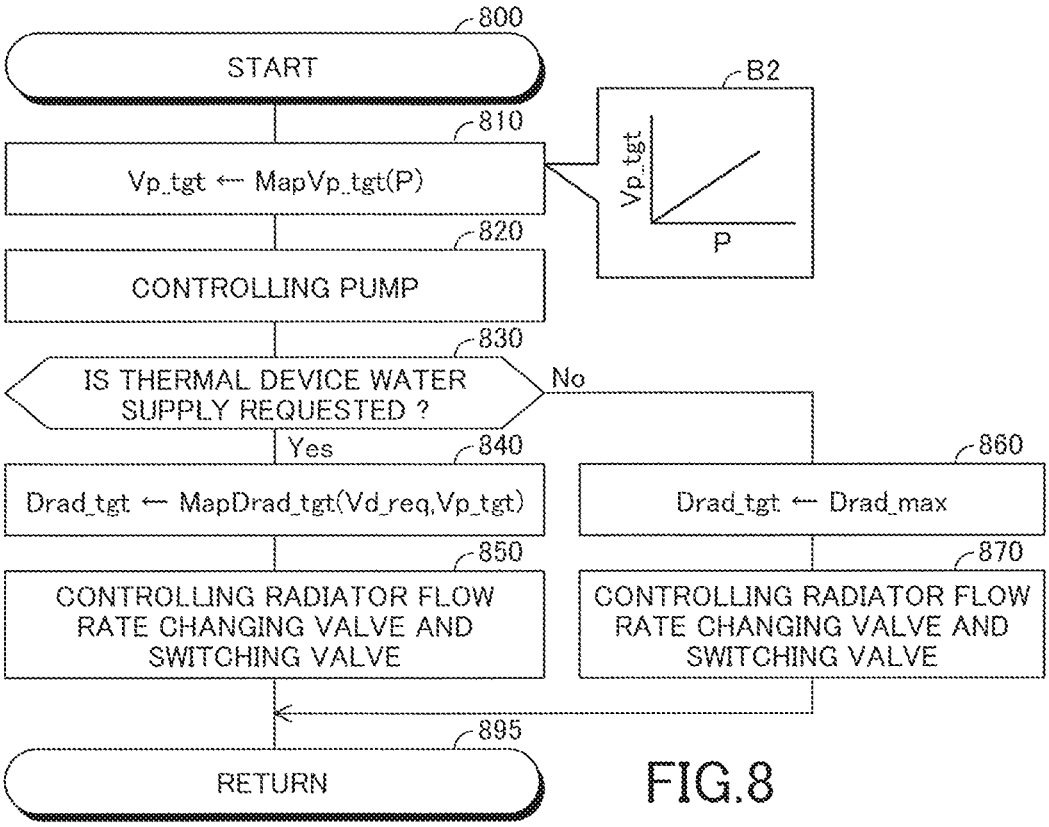
FIG. 8 is a flowchart for showing a routine executed by the CPU.

Further, the CPU is configured or programmed to execute a routine shown by a flowchart in FIG. 8 each time the predetermined time elapses. Therefore, at a predetermined timing, the CPU starts a process from a step 800 and then, sequentially executes processes of steps 810 and 820 described below. Then, the CPU proceeds with the process to a step 830.

Step 810: The CPU applies the engine output P to a look-up table MapVp_tgt(P) to acquire a target value Vp_tgt of the pump discharging flow rate Vp. Hereinafter, the target value Vp_tgt will be referred to as "the target discharging flor rate Vp_tgt." According to the look-up table MapVp_tgt (P), the acquired target discharging flow rate Vp_tgt increases as the engine output P increases.

Step 820: The CPU controls the activation of the pump 70 to accomplish the target discharging flow rate Vp_tgt acquired at the step 810.

When the CPU proceeds with the process to the step 830, the CPU determines whether the thermal device water supply is requested. When the thermal device water supply is requested, the CPU determines "Yes" at the step 830 and then, sequentially executes processes of steps 840 and 850 described below. Then, the CPU proceeds with the process to a step 895 to terminate this routine once.

Step 840: The CPU applies a flow rate Vd_req required as the flow rate of the cooling water to be supplied to the thermal device water passage 59 and the target discharging flow rate Vp_tgt acquired at the step 810 to a look-up table MapDrad_tgt(Vd_req, Vp_tgt) to acquire a target opening degree Drad_tgt of the radiator flow rate changing valve 76. According to the look-up table MapDrad_tgt(Vd_req, Vp_tgt), the acquired target opening degree Drad_tgt decreases as the flow rate Vd_req required as the flow rate of the cooling water to be supplied to the thermal device water passage 59 increases and the target discharging flow rate Vp_tgt increases.

Step 850: The CPU controls the opening degree of the radiator flow rate changing valve 76 and sets the switching valve 77 to the second position to accomplish the target opening degree Drad_tgt acquired at the step 840.

On the other hand, when the thermal device water supply is not requested at a time of the CPU executing the process of the step 830, the CPU determines "No" at the step 830 and then, sequentially executes processes of steps 860 and 870 described below. Then, the CPU proceeds with the process to the step 895 to terminate this routine once.

Step 860: The CPU sets the target opening degree Drad_tgt to a maximum value Drad_max.

Step 870: The CPU controls the opening degree of the radiator flow rate changing valve 76 to accomplish the target opening degree Drad_tgt acquired at the step 860 and sets the switching valve 77 to the first position.

The concrete operation of the embodiment apparatus has been described. According to the concrete operation, the cylinder block 15 is prevented from overheating when the engine operation state is in the large engine output area AL (see the determination "No" at the step 750 of FIG. 7).

It should be noted that the present invention is not limited to the aforementioned embodiment and various modifications can be employed within the scope of the present invention.

For example, the invention may be applied to the cooling apparatus that the thermal device water passage 59 and the switching valve 77 are omitted.

What is claimed is:

1. A cooling apparatus of an internal combustion engine, comprising:

a head water passage formed in a cylinder head of the internal combustion engine, through which cooling water for cooling the cylinder head flows;

a block water passage formed in a cylinder block of the internal combustion engine, through which the cooling water for cooling the cylinder block flows;

a pump for supplying the cooling water to the head and block water passages;

a flow rate changing valve for changing a cylinder head water flow rate proportion and a cylinder block water flow rate proportion, the cylinder head water flow rate proportion being a proportion of a flow rate of the cooling water supplied to the head water passage relative to a total water flow rate which is a sum of the flow rate of the cooling water supplied to the head water passage and the flow rate of the cooling water supplied to the block water passage, and the cylinder block water flow rate proportion being a proportion of the flow rate of the cooling water supplied to the block water passage relative to the total water flow rate; and an electronic control unit for controlling an activation of the flow rate changing valve on the basis of an engine output corresponding to an output of the internal combustion engine, wherein the electronic control unit is configured to:

control the activation of the flow rate changing valve such that the block water flow rate proportion is relatively larger when the engine output is relatively larger in a range of the engine output equal to or larger than a predetermined engine output, as compared to the block water flow rate proportion when the engine output is relatively smaller in the range of the engine output equal to or larger than the predetermined engine output, and control the activation of the flow rate changing valve such that the block water flow rate proportion is relatively smaller when the engine output is relatively larger in a range of the engine output smaller than the predetermined engine output, as compared to the block water flow rate proportion when the engine output is relatively smaller in the range of the engine output smaller than the predetermined engine output.

2. The cooling apparatus according to claim 1, wherein the electronic control unit is configured to control the activation of the flow rate changing valve such that the head water flow rate proportion is equal to or larger than the block water flow rate proportion when the engine output is smaller than the predetermined engine output.

3. The cooling apparatus according to claim 1, wherein the electronic control unit is configured to control an activation of the pump such that a flow rate of the cooling water discharged from the pump increases as the engine output increases.

4. The cooling apparatus according to claim 3, wherein the electronic control unit is configured to control the activation of the flow rate changing valve such that an increasing amount of the block water flow rate in response to a predetermined increasing amount of the engine output in a range of the engine output smaller than the predetermined engine output, is smaller than the increasing amount of the block water flow rate in response to the predetermined increasing amount of the engine output in a range of the engine output equal to or larger than the predetermined engine output.

5. The cooling apparatus according to claim 1, wherein the electronic control unit is configured to:

control the activation of the pump such that the flow rate of the cooling water discharged from the pump increases as the engine output increases; and the predetermined engine output is set to a value of the engine output in which an operation state of the pump corresponds to an operation state in which the cooling water having the flow rate capable of maintaining the temperature of the cylinder block equal to or lower than a predetermined block temperature, cannot be supplied to the block water passage.

6. The cooling apparatus according to claim 5, wherein the predetermined block temperature is set to the temperature of the cylinder block at which a friction resistance of a movable part provided in the cylinder block increases as the temperature of the cylinder block increases and is equal to or smaller than a predetermined friction resistance.

7. The cooling apparatus according to claim 1, wherein the electronic control unit is configured to control the activation of the pump such that the flow rate of the cooling water discharged from the pump increases as the engine output increases, and the predetermined engine output is set to a value of the engine output at which the flow rate of the cooling water discharged from the pump corresponds to an upper limit of the flow rate of the cooling water discharged from the pump.

8. The cooling apparatus according to claim 1, wherein the pump is an electric pump driven by electric power and the predetermined engine output is set to a value of the engine output at which the flow rate of the cooling water discharged from the pump corresponds to an upper limit of the flow rate of the cooling water discharged from the pump.

9. The cooling apparatus according to claim 1, wherein the pump is driven by rotation of a crank shaft of the internal combustion engine and the predetermined engine output is set to a value of the engine output when a speed of rotation of the internal combustion engine corresponds to a speed at which the flow rate of the cooling water discharged from the pump corresponds to an upper limit of the flow rate of the cooling water discharged from the pump.

* * * * *